US009849058B2

(12) United States Patent
Boyer

(10) Patent No.: US 9,849,058 B2
(45) Date of Patent: Dec. 26, 2017

(54) DEVICE FOR TREATING CELLULITE AND STRETCH MARKS

(71) Applicant: Daniel Boyer, Le Cres (FR)

(72) Inventor: Daniel Boyer, Le Cres (FR)

(73) Assignee: LPA CORP, Les Cres (FR)

( * ) Notice: Subject to any disclaimer, the term of this patent is extended or adjusted under 35 U.S.C. 154(b) by 402 days.

(21) Appl. No.: 14/443,858

(22) PCT Filed: Nov. 19, 2012

(86) PCT No.: PCT/FR2012/052664

§ 371 (c)(1),
(2) Date: May 19, 2015

(87) PCT Pub. No.: WO2013/072645

PCT Pub. Date: May 23, 2013

(65) Prior Publication Data

US 2015/0335518 A1 Nov. 26, 2015

(51) Int. Cl.
*A61H 9/00* (2006.01)

(52) U.S. Cl.
CPC ..... *A61H 9/0057* (2013.01); *A61H 2201/50* (2013.01); *A61H 2207/00* (2013.01)

(58) Field of Classification Search
None
See application file for complete search history.

(56) References Cited

U.S. PATENT DOCUMENTS

| | | | | |
|---|---|---|---|---|
| 8,273,037 B2 * | 9/2012 | Kreindel | ..... | A61H 9/0057 601/6 |
| 2012/0116271 A1 * | 5/2012 | Caruso | ..... | A61B 18/203 601/6 |
| 2012/0203148 A1 * | 8/2012 | Underwood | ..... | A61H 23/0236 601/47 |

(Continued)

FOREIGN PATENT DOCUMENTS

| | | |
|---|---|---|
| WO | 2008/114255 A1 | 9/2008 |
| WO | 2010/095856 A2 | 8/2010 |
| WO | 2011/021184 A1 | 2/2011 |

OTHER PUBLICATIONS

International Search Report, dated Apr. 8, 2014, from corresponding PCT application.

*Primary Examiner* — Stephen R Crow
(74) *Attorney, Agent, or Firm* — Young & Thompson

(57) ABSTRACT

A device for treating cellulite and stretch marks, includes:
- a unit (205, 215, 250) for placing a portion of the user's skin under negative pressure;
- a unit (205, 220, 50) for releasing the negative pressure and for placing the portion of the skin under relative positive pressure, including a plurality of chambers provided with a piston configured to strike the user's skin; and
- an element for controlling the negative pressure unit and the pressure-release and positive-pressure unit in order to produce cycles during which the negative pressure element and the pressure-release and positive-pressure element operate in turn. In some embodiments:
- the release unit includes an actuator controlling the position of the piston or
- the negative-pressure unit includes at least one chamber, which is provided, on one side, with a connection to a chamber placed under relative negative pressure.

15 Claims, 5 Drawing Sheets

(56) References Cited

U.S. PATENT DOCUMENTS

| | | | | |
|---|---|---|---|---|
| 2014/0276693 | A1* | 9/2014 | Altshuler | A61B 18/20<br>606/14 |
| 2017/0056636 | A1* | 3/2017 | Shadduck | A61M 35/003 |
| 2017/0173262 | A1* | 6/2017 | Veltz | A61M 5/1723 |

* cited by examiner

DEVICE FOR TREATING CELLULITE AND STRETCH MARKS

TECHNICAL FIELD OF THE INVENTION

The present invention relates to a device for treating cellulite and/or stretch marks. It applies, in particular, to the automatic treatment of cellulite or stretch marks on a user in a seated or lying position.

STATE OF THE ART

The most common and most conventional cellulite treatment is carried out at the physiotherapist. It uses lymphatic drainage and "kneading-rolling" massage with or without an appliance. The best-known of the appliances is the "Cellu m6" (registered trademark), which mechanizes two rollers inside a sort of treatment chamber in which there is an aspiration system. It is connected by a hose to a large base that supplies the power required for it to operate correctly. Negative pressure is created inside the chamber, which "suctions" the skin. And the rollers allow the "suction" to move over the skin. The operation must always be controlled by a professional. Finally, to decompress the blood and lymphatic vessels, these appliances move a suction phenomenon (negative pressure) over the skin.

The known treatment of cellulite is thus made by means of movements known as "kneading-rolling" by which a physiotherapist brings about the draining of cellulite in the skin's tissues. This treatment presents a number of drawbacks. Firstly, it is expensive because it needs the presence of an operator. Secondly, for this operator, it is time-consuming since the "kneading-rolling" movement requires strength and dexterity. Even if a device forming folds of skin is utilized, the operator must still move it over the patient's body. Lastly, treatment by "kneading-rolling" movements is only partially effective.

SUBJECT OF THE INVENTION

The present invention aims to remedy all or part of these drawbacks.

To this end, this invention envisages a device for treating cellulite, which comprises:

- a means for placing a portion of the user's skin under negative pressure;
- a means for releasing the negative pressure and for placing said portion of the skin under relative positive pressure, comprising a plurality of chambers provided with a piston configured to strike the user's skin; and
- a means for controlling the negative pressure means and the pressure-release and positive-pressure means in order to produce cycles during which the negative pressure means and the pressure-release and positive-pressure means operate in turn.

The user's skin therefore is subjected, successively, to suction towards the exterior of the user's body and then a strike.

The inventor has, in effect, discovered that these treatments are at least as effective as the kneading-rolling movement. In addition, as the device is automated, the presence of an operator is no longer necessary during the actual treatment, which avoids the operator's fatigue and high labor costs.

In some embodiments, the release means comprises an actuator controlling the position of the piston. Thanks to these provisions, each amplitude and frequency of a piston's movement can be controlled independently of the other pistons.

In some embodiments, the negative-pressure means comprises at least one chamber, which is provided, on one side, with a connection to a chamber placed under relative negative pressure.

Thanks to these provisions, a single chamber placed under relative negative pressure is enough for several chambers.

In some embodiments, at least one said piston is associated to a spring. Thanks to these provisions, releasing the negative pressure is easy to achieve.

In some embodiments, at least one said piston is moved by an electrical, electromagnetic or pneumatic motor.

In some embodiments, the release means is topped by a convex "cap". Thanks to these provisions, the skin's contact on the cap is airtight, which boosts the device's effect.

In some embodiments, the release means is topped by a cap having an opening, the piston comprising an upper cylinder, the base of which is configured to go through the opening of the cap, and a lower cylinder, the base of which has a surface area greater than the base of the upper cylinder.

Thanks to these provisions, the volume of air placed under negative pressure is greater than the volume of skin subjected to striking by the piston.

In some embodiments, the surface area of the base of the lower cylinder is at least one and a half times the surface area of the base of the upper cylinder.

In some embodiments, the surface area of the base of the lower cylinder is at least twice the surface area of the base of the upper cylinder.

The negative pressure effect is increased even more.

In some embodiments, the device that is the subject of the present invention comprises a source of compressed air and a compressed air distributor designed to successively supply compressed air to the means of moving the pistons. Thanks to these provisions, the device is made simpler and less costly.

In some embodiments, the device that is the subject of the present invention comprises, between at least two chambers, a light source. Thanks to these provisions, the device can carry out photo-modulation or light therapy.

In some embodiments, the device that is the subject of the present invention comprises a frame, on which a user can be placed in a seated position, the means of placing under negative pressure and the means of releasing pressure and placing under relatively negative pressure then being in contact with the user's skin. Thanks to these provisions, the user's thighs and buttocks can be treated.

In some embodiments, the device that is the subject of the present invention comprises a frame, on which a user can be placed in a lying position, the means of placing under negative pressure and the means of releasing pressure and placing under relatively negative pressure then being in contact with the user's skin. Thanks to these provisions, the user's stomach can be treated.

In some embodiments, said frame comprises at least one mobile portion designed to move a portion of the means of placing under negative pressure and the means of releasing pressure and placing under relatively negative pressure laterally, towards the user. Thanks to these provisions, the user's hips can also be treated.

In some embodiments:

- the device that is the subject of the present invention comprises a means of controlling a number of cycles of movement of the piston per unit of time;

the device that is the subject of the present invention comprises a means of controlling the speed of the piston while a portion of the skin is placed under negative pressure;

the device that is the subject of the present invention comprises a means of controlling the speed of the piston while the negative pressure is released;

the device that is the subject of the present invention comprises a means of controlling the amplitude of the piston's movement; and/or the device that is the subject of the present invention comprises a means of controlling a ratio of the duration of the negative pressure to the duration of releasing the negative pressure.

Thanks to each of these provisions, the treatment can be adapted to the user's profile and, in particular, to his skin.

BRIEF DESCRIPTION OF THE FIGURES

Other advantages, aims and particular features of the present invention will become apparent from the description that will follow, made, as a non-limiting example, with reference to the drawings included in an appendix, wherein.

DESCRIPTION OF EXAMPLES OF REALIZATION OF THE INVENTION

Figure 1:
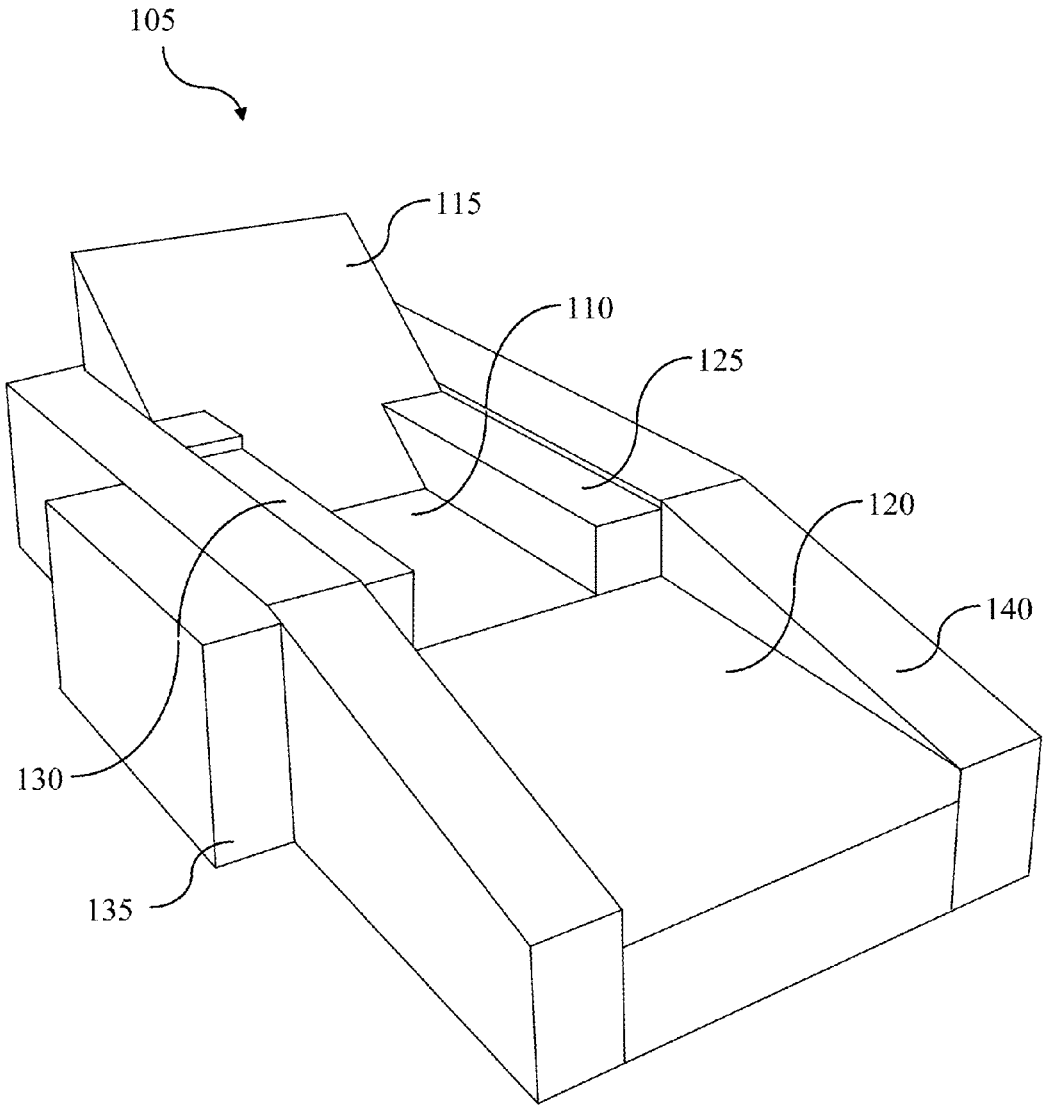
FIG. 1 represents, schematically and in perspective, a particular embodiment of the device that is the subject of the present invention.

The present invention relates to a chair type of mechanical device. Its utilization is intended to improve lipolysis, in a lying or seated position. In addition, the present invention allows the results of all the existing systems to be improved thanks to a new multiple cylinder effect. In effect, this device comprises a variable number of cylinders, incorporated into the seat of the chair. The movement of a piston in each cylinder induces the treatment process. Each piston rise in a cylinder leads to fragmentation of adipocytes by more or less strong and more or less prolonged contact against the skin. And each piston descent in a cylinder leads to stimulation of the lymphatic and blood circulation by larger or smaller and more or less prolonged vasodilation of the lymphatic and venous circuits.

The device that is the subject of the present invention thus reduces pre-pregnancy stretch marks and cellulite.

It has the advantages of being:

autonomous, since there is no need for a third-party operator to control it;

non-invasive, since there is no injection, no drain and no incision; and comfortable, since the user is lying down.

To this end, it utilizes the following functions:

producing kneading-rolling-striking massage waves;

suction;

striking; and, possibly, emitting light waves.

This treatment is carried out with regard to:

104 chambers or nozzles, which are the site of a series of "kneading-rolling-striking" massage waves, the adjustment of which makes it possible to set a level of frequency, speed, intensity and shape. In this way the treatment is adapted to the quality of the user's skin and cellulite; and 100 light-emitting diodes ("LEDs") which send treatment light waves over the entire area to be treated.

For example, during a session:

5,400 $cm^2$ of skin are treated;

a massage wave is produced every two, four or eight seconds;

9,360 suctions are carried out in each 30-minute session;

9,360 strikes are carried out in each 30-minute session.

The 100 light-emitting diodes permanently treat the entire surface of the skin area during the session.

In the case of treating pre-pregnancy stretch-marks, the goal is to improve the skin's elasticity (Collagen-Elastin). In effect, stretch-marks occur due to a lack of elasticity in the skin. The device that is the subject of the present invention, through its repeated suction and striking effects in each massage cycle, stretches the skin and makes it more elastic. The higher the skin's ability to stretch, the more it is spared from stretch-marks.

In the case of treating cellulite, it is noted that the human body arranges a natural breakdown of fats to provide energy: lipolysis. So that our metabolism can carry out effective lipolysis, it is necessary for the fats not to be released much. Otherwise, they find refuge in the adipocytes (cells specialized in the storage of fats) and cellulite appears. Consequently, the blood and lymphatic vessels are compressed and drainage becomes defective. The lymph can no longer retrieve the toxins and fats. Water is no longer eliminated, remains stuck and the skin takes on the "orange-peel" appearance.

The role of the "kneading-rolling" and "striking-suction" is to re-establish good lipolysis. The device that is the subject of the present invention thus combines several effects, applying them through adjustable massage waves:

suctions of adjustable power and number: negative pressure is created with regard to the skin;

strikes of adjustable power and number: A strike is created with regard to the skin to stimulate the circulation of the lymphatic and blood vessels and to break the adipocytes (cells responsible for storing fats).

Kneading-rolling-striking waves of strikes and suction move automatically over the entire area to be treated according to a predefined shape, speed and frequency.

In addition, in some embodiments, the device that is the subject of the present invention treats the skin with light waves generated by light-emitting diodes throughout the session.

FIG. 1 shows a device 105 that is the subject of the present invention, which comprises a seat 110, a seat-back 115, a foot-rest 120, mobile side portions 125 and 130, and a control module 135. A frame 140 bears the various elements of the device 105.

Figure 2:
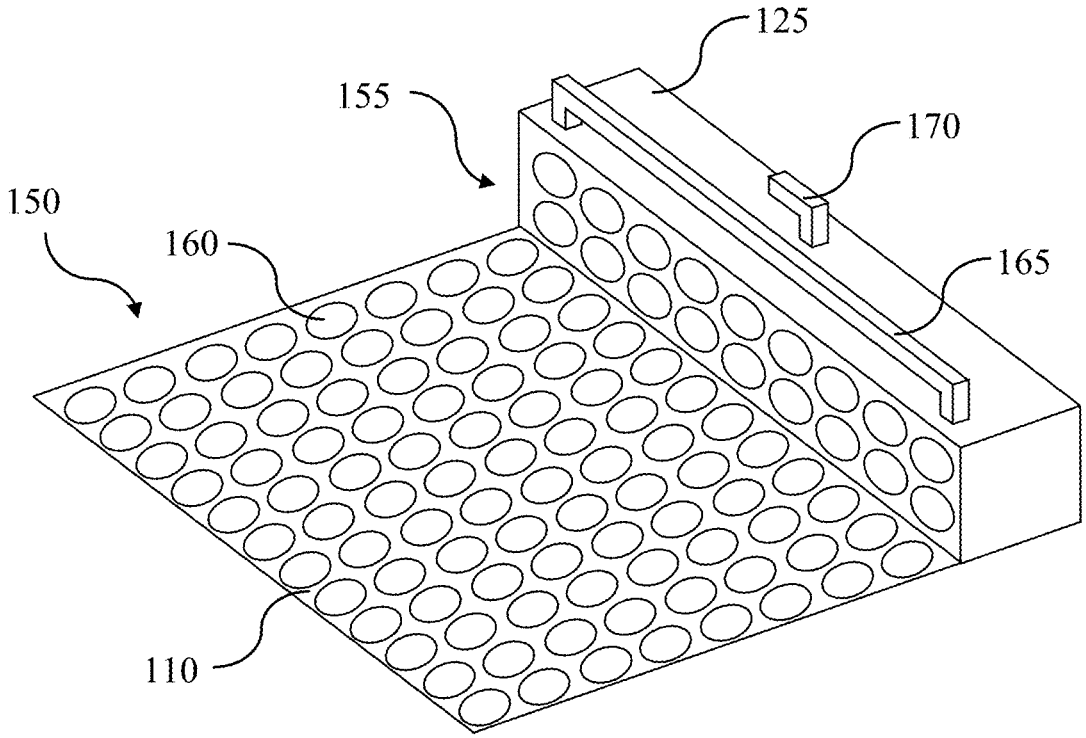
FIG. 2 represents, schematically and in perspective, the device shown in FIG. 1.
Figure 3:
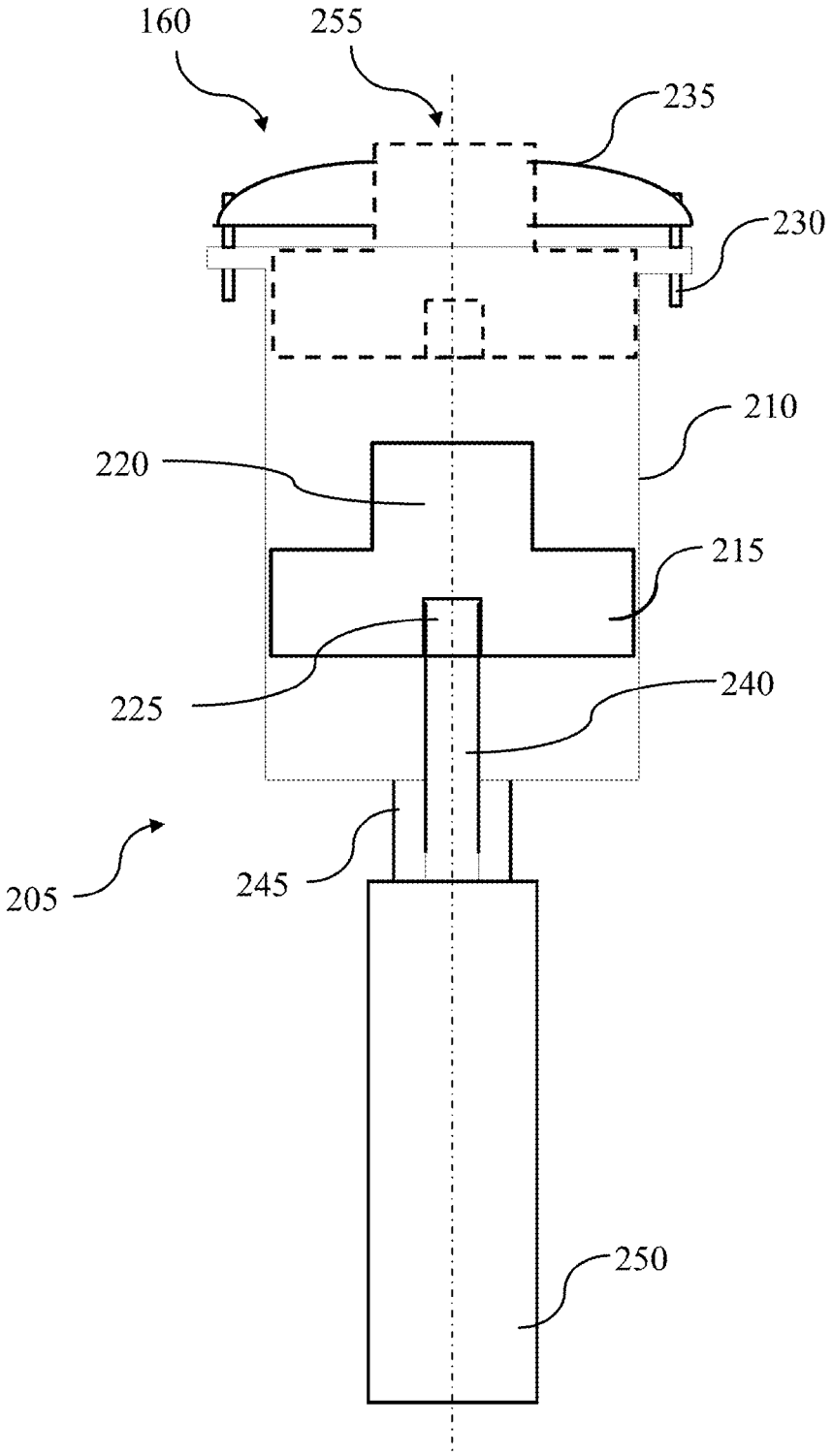
FIG. 3 represents, schematically and in cross-section, a chamber, or nozzle, of the device shown in FIGS. 1 and 2.
Figure 4:
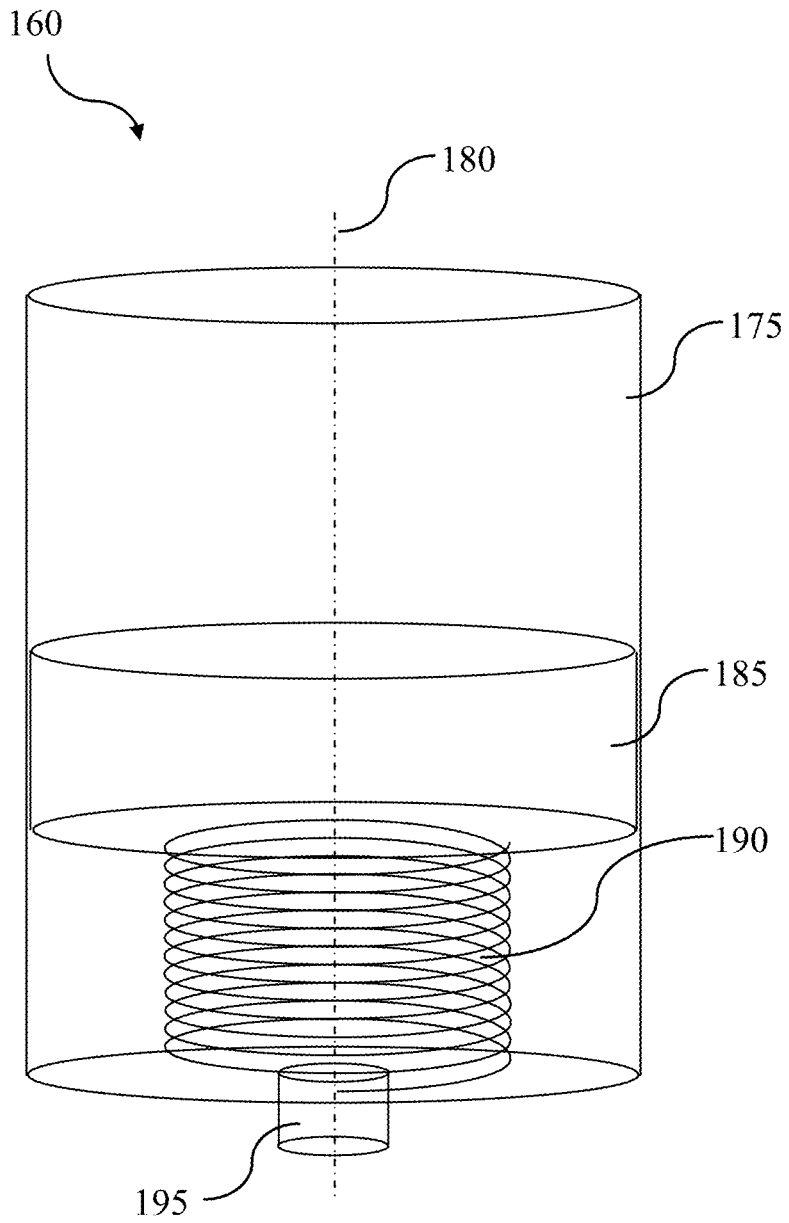
FIG. 4 represents, schematically and in perspective, a variant of the chamber, or nozzle, of the device shown in FIGS. 1 and 2.

Examples of realization of the seat 110 and the mobile side portion 125 are shown in FIG. 2. The chair 110 and the side portion 125 bear, respectively, a matrix 150 of suction chambers and a matrix 155 of suction chambers. Examples of suction chambers 160 are shown in FIGS. 3 and 4. The mobile side portion 125 is designed to slide on rails (not shown) extending perpendicular to the main axis of the device 105, along which the user is lying, between the mobile side portions 125 and 130.

In some variants, at least one on the matrices 150 and 155 of suction chambers 160 bears light sources to carry out treatment of the skin by photo-modulation or light therapy, at the same time as the cell treatment.

Each mobile side portion is equipped with a handle 165 for the user to sit up and either the handle 165 allowing an operator to move the mobile portion towards the center of the seat 110, or motorization, e.g. by actuator, such that the mobile portion touches the user's side or in the reverse direction to release the user. In the case of a manual movement, a bolt 170 makes it possible to lock the mobile side portion in position of contact with the user's skin.

Once the user is lying on the device 105, from the seat-back 115 to the foot-rest 120, the side portions 125 and 130 are brought to rest against the user's body. The cycle of suction and strikes on the user's skin is then initiated, produced by the suction chambers 160 under the control of elements of the control module 135 shown in FIG. 5.

The cellulite treatment device 105 thus comprises:

- a means for placing a portion of the user's skin under negative pressure;
- a means for releasing the negative pressure and for placing said portion of the skin under relative positive pressure, comprising a piston configured to strike the user's skin; and
- a means for controlling the negative pressure means and the pressure-release and positive-pressure means in order to produce cycles during which the negative pressure means and the pressure-release and positive-pressure means operate in turn.

In this way, the user's skin is subjected, successively, to suction towards the exterior of the user's body and then a strike. These treatments are at least as effective as the kneading-rolling movement. In addition, as the device 105 is automated, the presence of an operator is no longer necessary during the actual treatment, which avoids the operator's fatigue and high labor costs.

The framework of the device 105 is, for example, formed of metal tubes with a 30-mm square cross-section, welded together. This structure is divided into several portions, screwed together.

The inclination of the seat-back 115 is adjusted by an electrically-controlled actuator (not shown), whose control is made available to the user through a three-position switch.

The seat-back 115 is, for example, made of wood covered by an imitation leather covering padded with foam, with the following dimensions: 60×60 cm.

The foot-rest 120 is the fixed area, on which the legs lay. It is, for example, made of wood covered by an imitation leather covering padded with foam, with the following dimensions: 60×60 cm.

Between the two, the seat 110 of the device is, for example, made of an aluminum plate 10 mm thick and 60×60 cm in size. This seat 110 comprises, for example, 64 main openings 160 in eight rows of eight 36-mm diameter holes, distributed over the entire length and width of the seat. In FIG. 2, 96 main openings are shown. In addition, four smaller holes, secondary and reamed, surround each main opening 160.

Each main opening 160 receives the body 210 of a chamber, or nozzle, 205 fastened by screwing screws 230 into the secondary reamed holes. The nozzles 205 are, for example, made of aluminum.

In an embodiment described with reference to FIG. 3, the nozzles 205 are hollow. In the bottom of each nozzle 205, in the lower portion, an opening with a screw thread 245 allows the nozzle 205 to be attached to the outer fixed portion, or "body" of an actuator 250. A convex "cap" 235 having a 25 mm-diameter central hole 255 is screwed onto each nozzle 205. The convex shape of the cap 235 makes it possible, when the skin bears on the lips of the hole 255, to be airtight, which boosts the effect of the device 105.

Each nozzle 205 is inserted into a main opening of the seat and comprises an inner piston made of plastic, having the general shape of two cylinders of revolution 215 and 220, the smaller of which, 220, located above the larger, 215, has a diameter slightly smaller than the diameter of the central hole 255 of the cap 235 of the nozzle 205. This piston has a screw-thread 225 at the base of the cylinder 215. The outer extremity of the mobile portion 240 of the actuator 250 is screwed into the screw-thread at the base of the cylinder 215.

Because the base of the cylinder 220 has a smaller surface area than the base of the cylinder 215, the volume of air placed under negative pressure is greater than the volume of skin subjected to striking by the piston. Preferably, the surface area of the base of the lower cylinder 215 is at least one and a half times the surface area of the base of the upper cylinder 220. Preferably, the surface area of the base of the lower cylinder 215 is at least twice the surface area of the base of the upper cylinder 220. The negative pressure effect is increased even more.

Activating the actuator 250 makes the piston, formed of cylinders 215 and 220 in the nozzle 205, rise and descend. In the upper position, represented by dashed lines, the head 215 of the piston extends several mm beyond the cap 235, and therefore the plane of the seat, thus creating a strike against the portion of the user's skin that is in front of the nozzle 205.

The actuators 250 are motorized by two groups of pumps (not shown) that produce compressed air. The first group is located below the seat-back 115. The second group is located under the foot-rest 120.

The compressed air supplied by these two groups is channeled towards distributors whose role is to distribute the air to the actuators 250 associated to the nozzles 205.

The compressed air distributor, designed to successively supply compressed air to the means of moving the pistons, simplifies the device and makes it less expensive.

On each side of the seat 110, a mobile structure 125 made of aluminum is installed, in which nozzles 205 are incorporated in two rows of ten or twelve nozzles 205.

Each mobile structure 125 is, for example, 60 cm long and, for example, 13 cm high. The nozzles 205 of each mobile structure 125 are identical to those described above.

Each of the two side structures 125 is motorized by an actuator (not shown) allowing it to be brought closer to the center of the seat 110 and thus come into contact with the user's hips, during the treatment session.

On the mount, made of aluminum, of the seat 110 and side structures 125, bands of light-emitting diodes (not shown) separate the rows of nozzles 205. These diodes emit a cold white light. The diodes are powered by two transformers (not shown).

A programmable logic controller 320 or a computer is connected to a touch screen (not shown) installed on an arm-rest of the device 105. This touch screen allows different programs to be selected.

Several pages are successively displayed on this touch screen. A first page allows a program to be selected according to the quality of the skin, Fragile/Sensitive/Normal, and a session length in 10-minute blocks. A second page is reserved for a professional, who produces programs by defining a speed of the massage wave; an intensity of the suctions; an intensity of the strikes, a ratio of the length of the suction to the length of the strike in the cycle, and a session length. A third page allows a specific setting for cleaning the mechanized surface. A fourth page is reserved for maintenance, to diagnose any problems.

Bodywork surrounds the structure and the portions described above to enclose the entire mechanical portion. This bodywork is, for example, made of metal. The bodywork is retractable to allow access to all the parts of the device 105.

The cellulite treatment is carried out in the area of the seat 110, i.e. anatomically with reference to the entire buttocks, hips and thighs.

Powering up the device switches on the two compressed-air generators that are going to actuate the 104 actuators 250. Each actuator 250, attached to a nozzle 205, sets a piston 215 and 220 inside a nozzle 205 into a forwards-and-backwards motion. In front of each nozzle 205, when negative pressure is created, the skin is subjected to a suction phenomenon. And when the actuator 250 makes the piston 215 and 220 rise, a strike is created on the skin. Throughout the session, the 100 LEDs remain lit. Everything is managed by the programmable logic controller 320, which can adjust the frequency, length, level of intensity and shape of the massage wave. For cellulite on the abdomen, the user lies on his stomach.

In an embodiment described with reference to FIG. 4, each suction chamber 160 is comprised of a cylinder 175 with a circular base, of axis 180. In this cylinder 175 there is a mobile piston 185 bearing on a spring 190 acting in compression. An opening 195 is connected to a chamber 300 placed under relative negative pressure by a pump 305. The upper opening of the suction chamber 160 has a lip designed to prevent air leaks when a portion of the user's skin is bearing against this opening. This lip is rounded so as not to hurt the user.

The piston 185 provides sufficient airtightness between the two portions of the cylinder it separates so that the negative pressure produced by the pump 305 causes the piston 185 to move and the spring 190 to be compressed. The negative pressure produced by the pump 305 also causes the suction of a portion of the user's skin.

When the negative pressure is released, by the abrupt opening of a solenoid valve, the spring 190 propels the piston onto the portion of the user's skin located in the cylinder 175 and strikes it, which has the effect of making the cellulite circulate. The strike produced by the piston is more vigorous than a simple pneumatic overpressure, which can, nevertheless, be produced in variants of the device that is the subject of the present invention.

It is noted that a single pump 305 is sufficient for a large number of suction chambers 160. However, in a variant, a plurality of pumps is utilized. In some variants, at least one said piston is moved by an electrical or electromagnetic motor. In some variants, the user is seated on the device, not lying down.

The advantages of this device are to make the treatment of cellulite:

- more comfortable, because the user can take a seated or lying treatment position;
- easier, because the treatment requires no personal manipulation or intervention by a third party; and
- more effective, because the conventional "kneading-rolling" is replaced by "striking-suction", a new concept, which is more effective physiologically.

Figure 5:
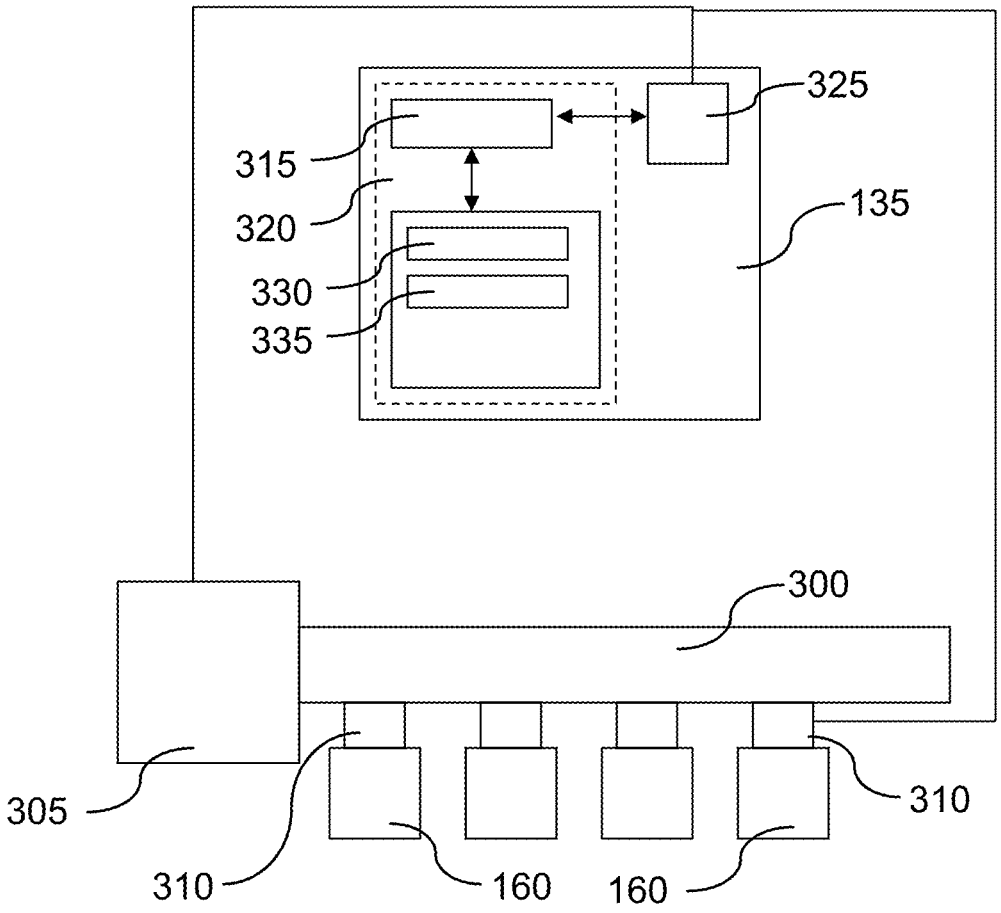
FIG. 5 represents, as a block-diagram, the means of controlling the device illustrated in FIGS. 1 to 4.

In the embodiment shown in FIG. 5, each suction chamber 160 is associated to a solenoid valve 310. This arrangement allows the actions on the different portions of the skin to be de-synchronized.

FIG. 5 also shows elements of the control module 135:

- an electronics board, or programmable logic controller, 320; and
- an interface 325, which controls the pump 305, each solenoid valve 310, each actuator of the mobile structure 125 and seat-back 115, and the touch screen.

The electronics board 320 constitutes, for example, a general-purpose computer. It has a central processing unit 315 and memories 330 and 335. The memory 330 stores instructions of an operating program for the device 105. Memory 335 stores data identifying the user so that his successive treatments are stored.

The electronics board associated to the touch screen forms a means of controlling:

- a number of cycles of movement of the piston by unit of time;
- the speed of the piston while a portion of the skin is placed under negative pressure;
- the speed of the piston while the negative pressure is released;
- the amplitude of the piston's movement; and/or
- a ratio of the duration of the negative pressure to the duration of releasing the negative pressure.

In this way, the treatment applied to each user can be adjusted to his profile and, in particular, to his type of skin.

In some variants, the seat and side portions are curved, not flat in shape, to adapt to the shape of the user's body. In some variants, the mountings of the suction chamber matrices are flexible to adapt to different morphologies of users.

In general, the cellulite treatment device comprises:

- a means for placing a portion of the user's skin under negative pressure;
- a means for releasing the negative pressure and for placing said portion of the skin under relative positive pressure, comprising a plurality of chambers provided with a piston configured to strike the user's skin; and
- a means for controlling the negative pressure means and the pressure-release and positive-pressure means in order to produce cycles during which the negative pressure means and the pressure-release and positive-pressure means operate in turn.

It is noted that the negative-pressure means can be independent of the pressure-release means. For example, a suction chamber can be coupled to a piston that does not have an effect of air suction but only of striking the skin.

It is also noted that, in some embodiments, at least one piston is moved by an electrical, electromagnetic or pneumatic motor.

The invention claimed is:

1. Device for treating cellulite, that comprises:

- a means for placing a portion of the user's skin under negative pressure;
- a means for releasing the negative pressure and for placing said portion of the skin under relative positive pressure, comprising a plurality of chambers provided with a piston configured to strike the user's skin;
- a means for controlling the negative pressure means and the pressure-release and positive-pressure means in order to produce cycles during which the negative pressure means and the pressure-release and positive-pressure means operate in turn and
- a frame, on which a user can be placed in a seated position and/or a lying position, the means of placing under negative pressure and the means of releasing pressure and placing under relatively negative pressure then being in contact with the user's skin.

2. Device according to claim 1, wherein the release means comprises an actuator controlling the position of the piston.

3. Device according to claim 1, wherein the negative-pressure means comprises at least one chamber, which is provided, on one side, with a connection to a chamber placed under relative negative pressure.

4. Device according to claim 3, wherein at least one said piston is associated to a spring.

5. Device according to claim 3, wherein at least one said piston is moved by an electrical, electromagnetic or pneumatic motor.

6. Device according to claim 1, wherein the release means is topped by a convex cap.

7. Device according to claim 1, wherein the release means is topped by a cap having an opening, the piston comprising an upper cylinder, the base of which is configured to go through the opening of the cap, and a lower cylinder, the base of which has a surface area greater than the base of the upper cylinder.

8. Device according to claim 7, wherein the surface area of the base of the lower cylinder is at least one and a half times the surface area of the base of the upper cylinder.

9. Device according to claim 8, wherein the surface area of the base of the lower cylinder is at least twice the surface area of the base of the upper cylinder.

10. Device according to claim 1, that comprises a source of compressed air and a compressed air distributor designed to successively supply compressed air to the means of moving the pistons.

11. Device according to claim 1, that comprises, between at least two chambers, a light source.

12. Device according to claim 1, wherein said frame comprises at least one mobile portion designed to move a portion of the means of placing under negative pressure and the means of releasing pressure and placing under relatively negative pressure laterally, towards the user.

13. Device according to claim 1, that comprises a means of controlling the speed of the piston while a portion of the skin is placed under negative pressure and/or while the negative pressure is released.

14. Device according to claim 1, that comprises a means of controlling the amplitude of the piston's movement.

15. Device according to claim 1, that comprises a means of controlling a ratio of the duration of the negative pressure to the duration of releasing the negative pressure.

* * * * *